US006519811B1

(12) United States Patent
Cheng

(10) Patent No.: US 6,519,811 B1
(45) Date of Patent: Feb. 18, 2003

(54) PIVOT HINGE ASSEMBLY FOR GLASS STRUCTURE

(76) Inventor: Ko-Ming Cheng, No. 9-60, Hsi-Liao Rd., Hsi-Liao Village, Ta-Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 10/118,142

(22) Filed: Apr. 9, 2002

(51) Int. Cl.[7] ..... E05D 11/10; E05D 5/00

(52) U.S. Cl. ..... 16/252; 16/332; 16/334; 16/382

(58) Field of Search ..... 16/250, 251, 252, 16/280, 284, 286, 331, 332, 334, 335, 336, 327, 342, 378; 160/199, 206, 210, 213; 4/556

(56) References Cited

U.S. PATENT DOCUMENTS 3,657,766 A * 4/1972 Peterson ..... 16/281
5,079,798 A * 1/1992 Burke et al. ..... 16/252
5,297,313 A * 3/1994 Brin ..... 16/252
5,867,869 A * 2/1999 Garrett et al. ..... 16/252
6,161,255 A * 12/2000 Garrett ..... 16/284

* cited by examiner

*Primary Examiner*—Anthony Knight
*Assistant Examiner*—Vishal Patel
(74) *Attorney, Agent, or Firm*—Fei-Fei Chao; Venable, Baetjer, Howard & Civiletti, LLP

(57) ABSTRACT

A pivot hinge assembly for a glass structure includes a central shaft adapted to be securely mounted on the doorframe, a driving housing having an axial passage extending through the driving housing to receive therein the central shaft and a radial passage defined to extend through the driving housing and intercept the axial passage. Two pivoting devices are respectively and oppositely received in the radial passage. Each pivoting device is spaced away from one another by the central shaft. A support has a U shaped seat formed to securely receive therein the driving housing and the two pivoting devices. A piece of glass of the pivot door is able to drive the two pivoting devices to pivot relative to the central shaft so as to facilitate the smoothness of pivotable movement of the pivot door.

8 Claims, 7 Drawing Sheets

PIVOT HINGE ASSEMBLY FOR GLASS STRUCTURE

BACKGROUND OF THE INVENTION

1. Field of the Invention

The present invention relates to a hinge, and more particularly to a pivot hinge assembly for a glass structure. The pivot hinge has two pivoting devices received in a housing so that the user is able to mount the hinge on top/bottom edges of either left or right sided doors.

2. Description of Related Art

A hinge normally is mounted on a side face of a pivot doorframe. Because the hinges for right and left pivot doors are structurally different, the hinges cannot be applied to both the left and the right pivot doors. Further, the conventional hinges are not mounted on top or bottom side faces of the doorframe but the right or the left side faces of the doorframe. Therefore, the left door can only use the hinge made for the left side door and the right door can only use the hinge adaptable for the right side door. Therefore, the manufacturers of the hinges will have two different models for making these two different hinges and retailers have to keep in stock twice as many hinges relative to the number of doors customers wish to hang. Accordingly, the cost for making, storing an d marketing the two different hinges is high.

To overcome the shortcomings, the present invention tends to provide an improved hinge to mitigate and obviate the aforementioned problems.

SUMMARY OF THE INVENTION

The primary objective of the present invention is to provide an improved pivot hinge assembly for a glass structure in which rolling friction is used to replace plan surface friction as applied to the conventional hinge so as to ensure a smooth movement of the pivot door.

In order to accomplish the foregoing objective, the hinge has two pivoting devices connecting to a central shaft which is secured to the pivot door. Each pivoting device has a roller and the central shaft has two grooves peripherally and oppositely defined in a face of the central shaft so as that each one of the grooves corresponds to one of the rollers. When the pivot door is closed, each roller is rested in the corresponding groove in the central shaft. When the pivot door is pivoted, the engagement between the cylindrical rollers and the cylindrical central shaft enhances the smooth motion of the pivot door.

Other objects, advantages and novel features of the invention will become more apparent from the following detailed description when taken in conjunction with the accompanying drawings.

DETAILED DESCRIPTION OF THE PREFERRED EMBODIMENT

Figure 1:
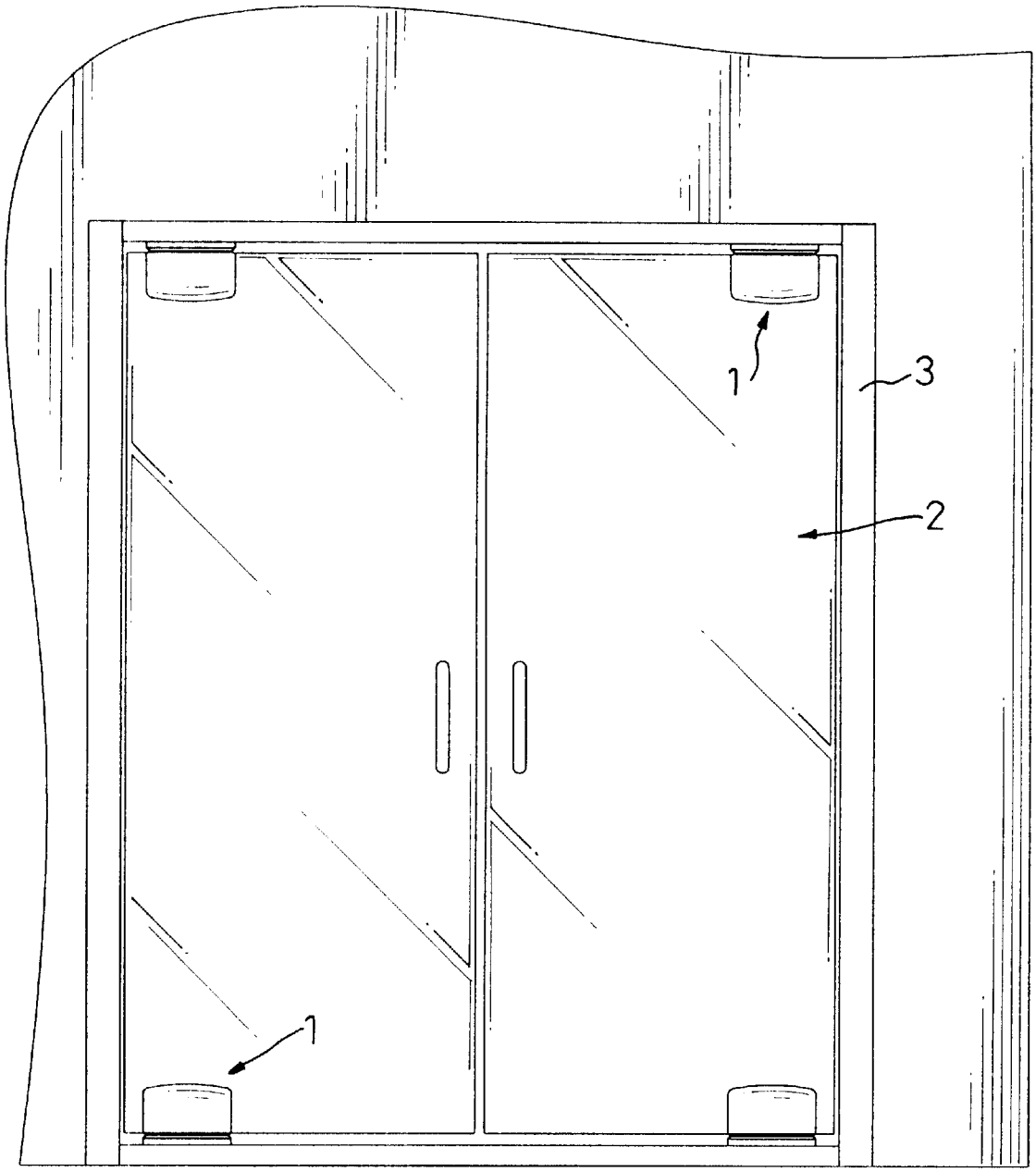
FIG. 1 is a plan view showing the location of the hinge of the present invention in respect to a pivot door.

With reference to FIG. 1, it is noted that the pivot hinge assembly (1) constructed in accordance with the present invention is adapted to be mounted on top and bottom edges of a pivot door (2) and connected to the corresponding side faces of a doorframe (3).

Figure 2:
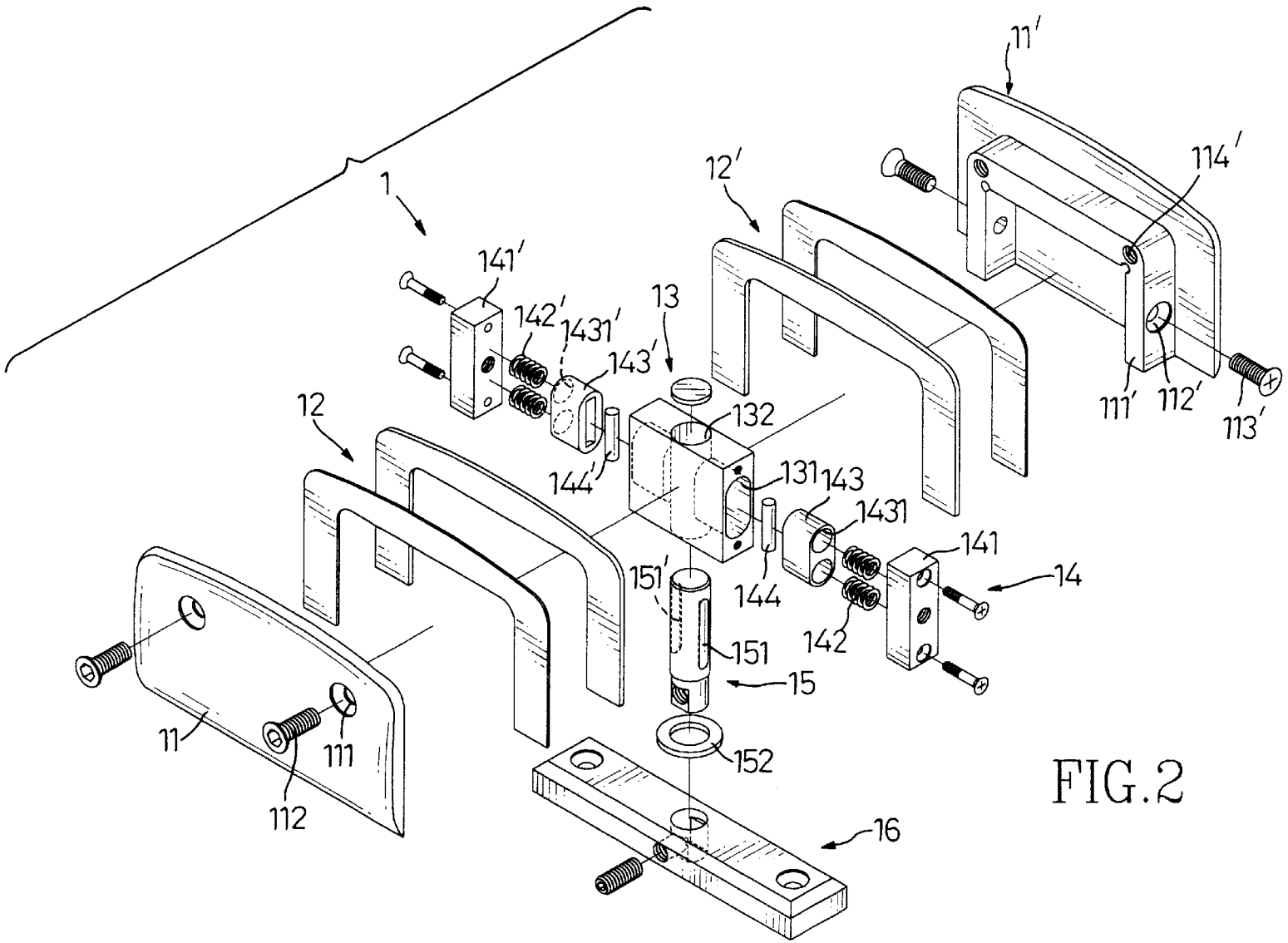
FIG. 2 is an exploded perspective view of the hinge of the present invention.

FIG. 2 shows that the hinge assembly (1) of the present invention is composed of a cover comprising a front cover (11) and a support (11'), two pairs of cushion pads (12,12'), a driving housing (13), two pivoting devices (14) each received in the driving housing (13), a central shaft (15) extending into the driving housing (13) to respectively engage with both pivoting devices (14) and a base (16) to be securely engaged with a side face of the doorframe (3).

As noted from the drawing the front cover (11) has two screw holes (111) and two screws (112) each extending through a corresponding one of the two screw holes (111). The support (11') has a U shaped seat ( 111') formed on a side face of the support (11') and the seat (111') has two oppositely defined securing holes (112') each defined in a respective side face of the seat (111') to correspond to a securing screw (113') respectively. The support (11') further has two holes (114') defined to correspond to the two screws (112) of the front cover (11). Each one of the cushion pads (12,12') is configured to have a U shape to correspond to the seat (111') so that the cushion pads (12,12') are able to be mounted on the seat (111').

The driving housing (13) has a radial passage (131) and an axial passage (132) intercepting with the radial passage (131). Each of the radial and axial passages (131,132) are defined through the driving housing (13).

As previously described, the hinge of the present invention has two pivoting devices (14) each having the same parts. Each pivoting device (14) is received in the driving housing (13) and located opposite to each other. Therefore, the following description is focused only on the structure of the parts of one pivoting device (14). Each pivoting device (14) includes a plug (141,141'), at least one spring (142,142') (two are shown in the embodiment), a sleeve (143,143') and a roller (144,144'). The plug (141,141') is securely engaged with the driving housing (13) to close an exit of the radial passage (131). The sleeve (143,143') is received in the radial passage (131) and provided with at least one channel (1431, 1431') to receive therein the at least one spring (142,142'). After the at least one spring (142,142') is received in the channel (1431,1431') and the plug (141,141') is secured to a side face of the driving housing (13) to close the exit of the radial passage (131), the at least one spring (142,142') abuts a periphery of the roller (144,144').

The central shaft (15) is securely mounted on a mediate portion of the base (16) and extends into the axial passage (132) of the driving housing (13) so that the roller (144,144') is held in place by both the at least one spring (142,142') and the central shaft (15). A washer (152) may be applied between the central shaft (15) and the base (16). In order to further hold the roller (144,144') in place, the central shaft

(15) has two grooves (151,151') peripherally and oppositely defined therein to correspond to the rollers (144,144') of the pivoting devices (14) such that the rollers (144,144') are able to be snugly received in the grooves (151,151').

Figure 3:
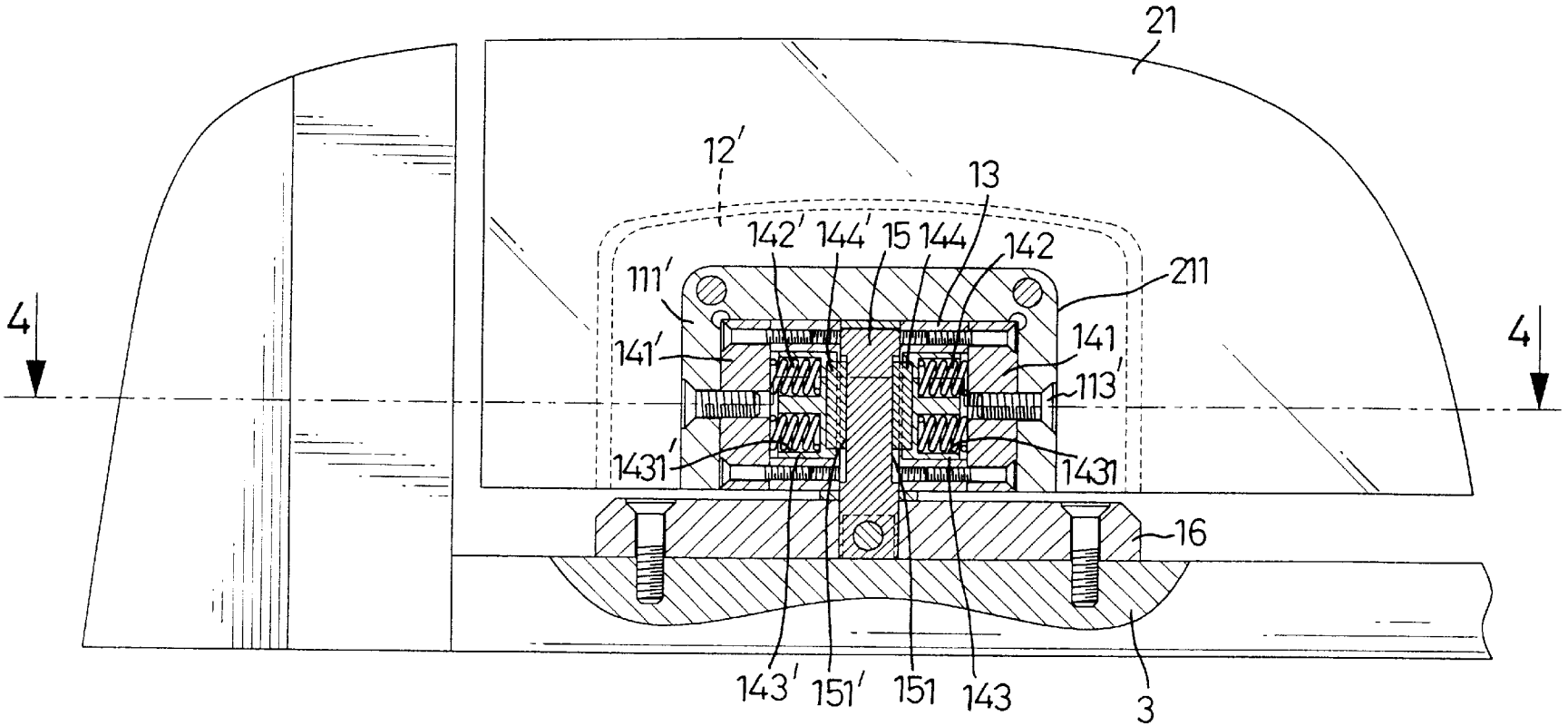
FIG. 3 is a front sectional view of the assembled hinge mounted on the doorframe, wherein for clarity, the front cover and the cushion pads are removed.
Figure 4:
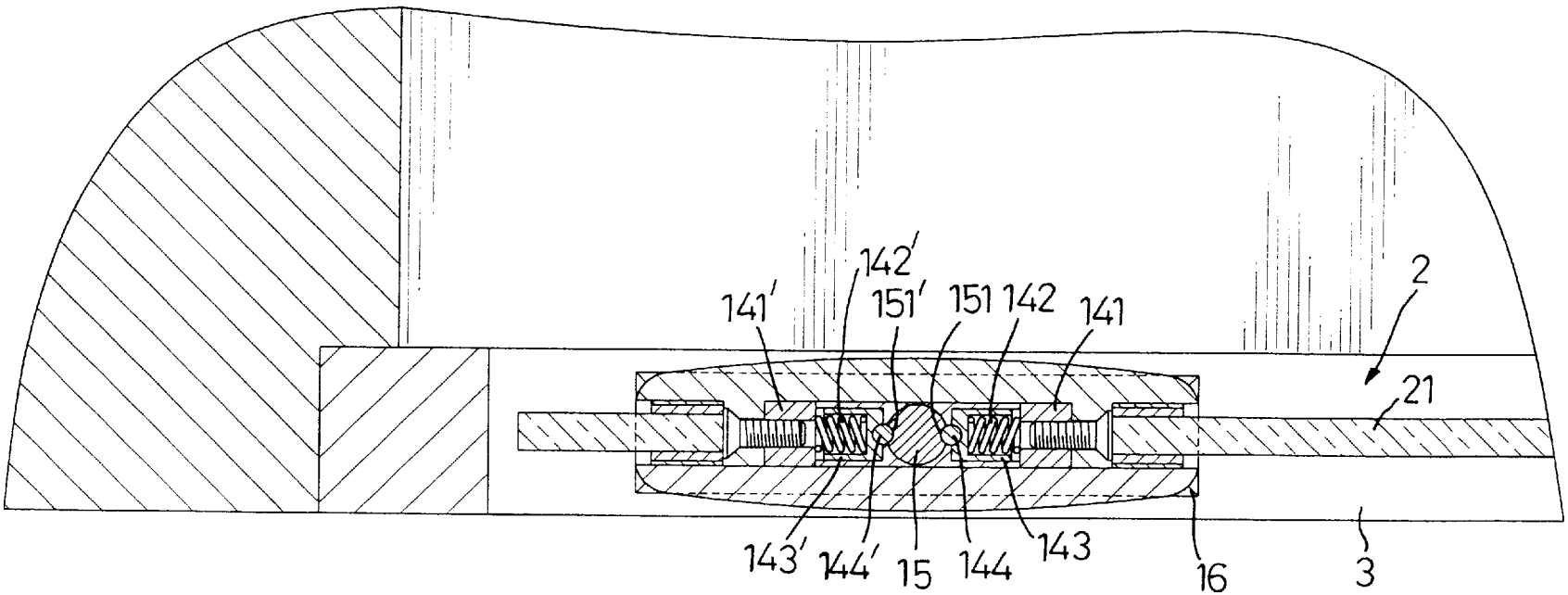
FIG. 4 is a top cross sectional view showing the corresponding locations of the parts in the hinge when mounted on the doorframe.
Figure 5:
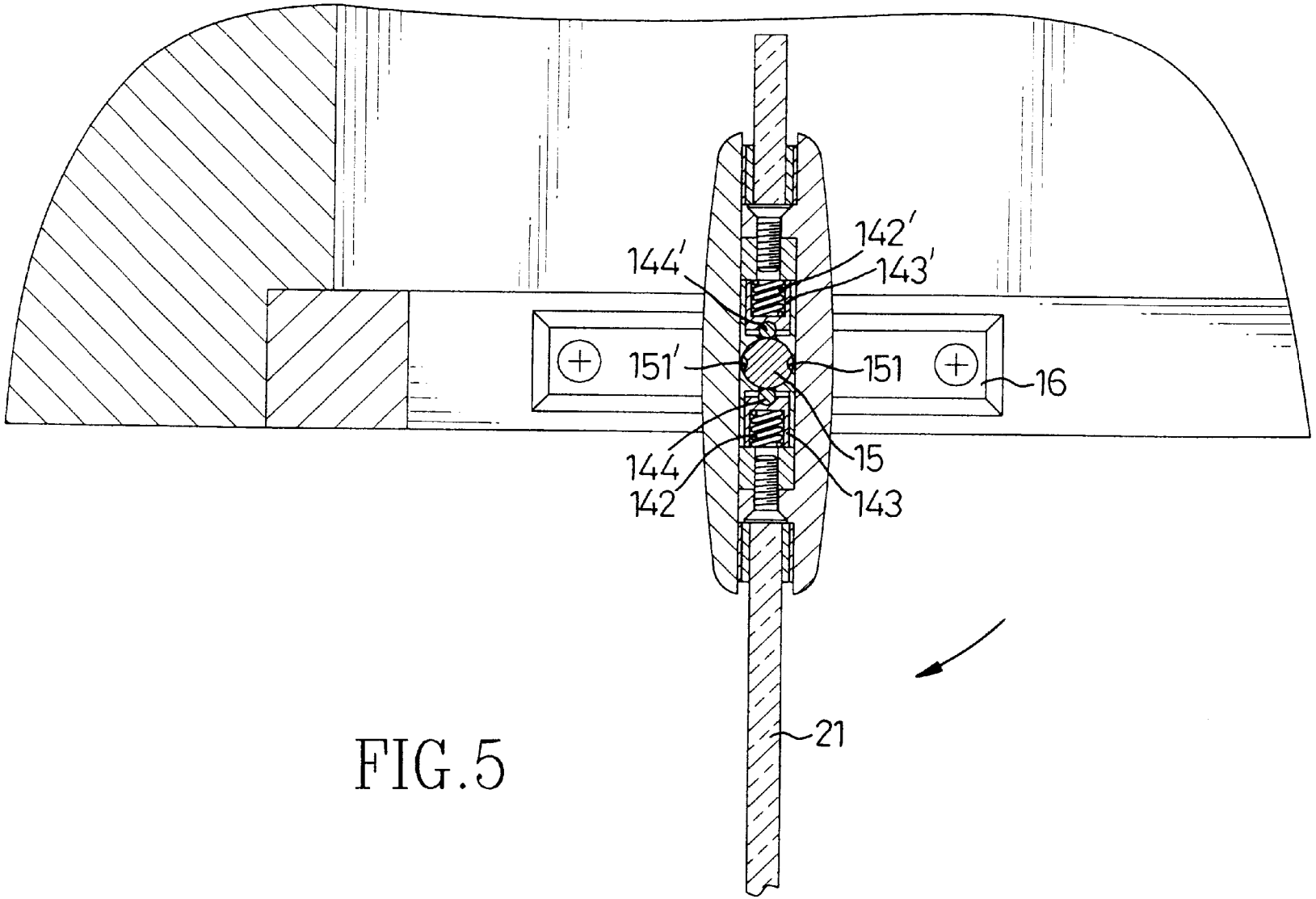
FIG. 5 is a top cross sectional view showing the pivot door is pivoted as well as the hinge.

Referring to FIGS. 3, 4 and 5, when the hinge (1) of the present invention is to be assembled, the central shaft (15) is secured on the base (16) and extends into the axial passage (132). The rollers (144,144') are received in the driving housing (13) from each exit of the radial passages (131) so that each one of the rollers (144,144') corresponds to one of the grooves (151,151') of the central shaft (15). Thereafter, the sleeves (143,143') with the at least one spring (142,142') received therein are received in the driving housing (13) from different exits of the radial passage (131) to allow the at least one spring (142,142') to abut the periphery of the rollers (144,144'). After the sleeves (143,143') are received in the driving housing (13), the plugs (141,141') are firmly secured to opposite side faces of the driving housing (13) to close the exits of the radial passage (131). Thus, the rollers (144,144') are pushed toward the central shaft (15) by the at least one spring (142,142'). Then, the U shaped cushion pads (12') are placed on the U shaped seat (111'). The securing screws (113') are screwed through the securing holes (112') and into the side face of the plugs (141,141') to secure the engagement of the plugs (141,141') to the support (11').

Referring to FIG. 3, when all the foregoing assembly is finished, a piece of glass (21) with a cutout (211) corresponding to the U shaped seat (111') is placed on the semi-assembled structure. Thereafter, the cushion pads (12) are placed on the seat (111') and then the front cover (11) is securely connected to the support (11') by the screws (112) extending through the screw holes (111) and into the corresponding holes (114') of the support (11'), such that the piece of glass (21) is clamped by the front cover (11) and the support (11'). Finally, the base (16) is securely mounted on the doorframe (3).

With reference to FIG. 4, it is notable that when the pivot door (2) is not pivoted, the rollers (144,144') are respectively received in the corresponding grooves (151,151') so as to function as a positioning seat to the pivot door (2), such that when the pivot door (2) is not pivoted by a user, the rollers (144,144') in combination with the grooves (151,151') are able to prevent the pivot door (2) from shaking or vibrating due to any other factors.

However, when a user pushes either piece of the glass (21) of the pivot door (2), the piece of glass (21) pivots about the central shaft (15) which is firmly secured to the base (16). Therefore, the rollers (144,144') are away from their corresponding grooves (151,151') and roll on the outer periphery of the central shaft (15). The rolling engagement of the rollers (144,144') to the outer periphery of the central shaft (15) facilitates the smoothness of the pivotal movement of the pivot door. As the friction of the hinge (1) is reduced by the rolling engagement, the life span of the hinge is long.

Moreover, because the hinge of the present invention has two pivoting devices (14), the hinge (1) is able to be mounted on either the right or the left piece of glass (21) of the pivot door (2), such that the user or the manufacturers are able to reduce the costs of fabrication and storage.

Figure 6:
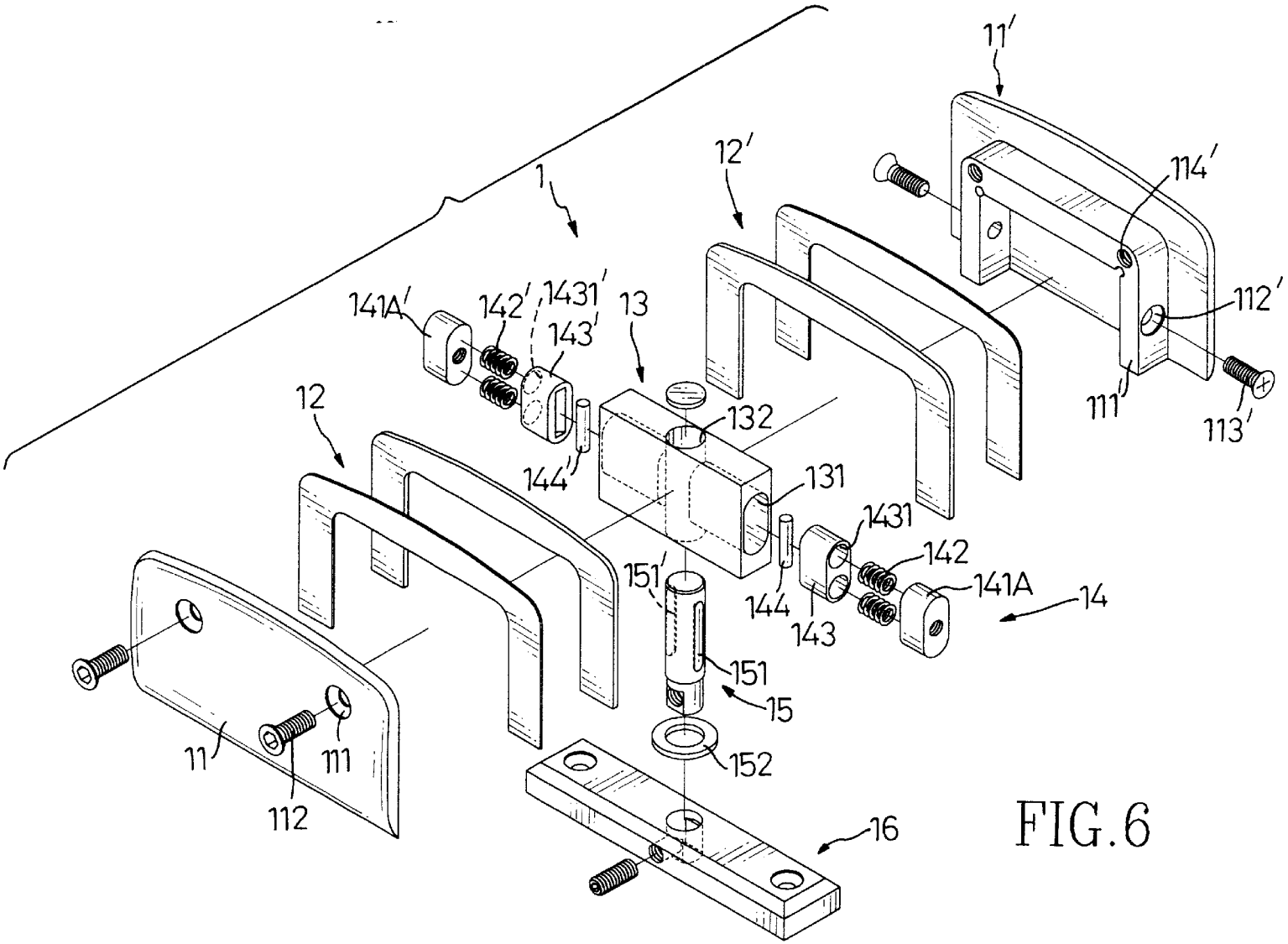
FIG. 6 is an exploded perspective view of the pivot hinge of the second embodiment of the present invention.
Figure 7:
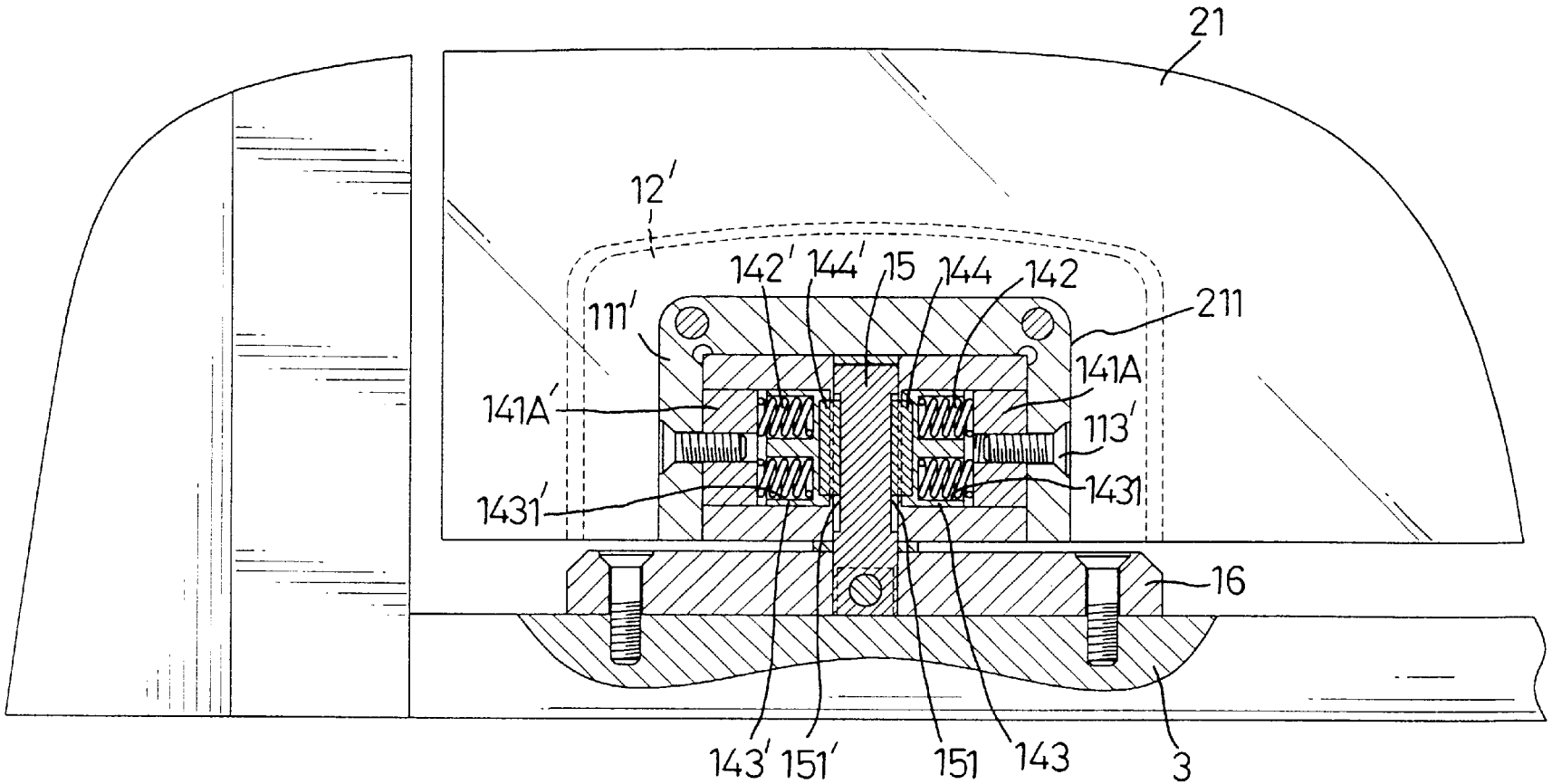
FIG. 7 is a front sectional view of the assembled hinge of the second embodiment of the present invention, wherein both the plugs are respectively received in a corresponding one of the radial passages in the driving housing.

With reference to FIGS. 6 and 7, the dimension of the plugs (141A,141A') is smaller than that shown in the first embodiment so that both plugs (141A,141A') are able to be received in the radial passage (131) to abut a corresponding one of the at least one spring (142,142') in the driving housing (13). After the plugs (141A,141A') are received in the radial passage (131), the engagement between the plugs (141A,141A') and an inner face of the radial passage (131) is interference fit. According to the engagement between the plugs (141A,141 A') and the inner face of the radial passage (131) the pivot device (14) together with the driving housing (13) is able to be received in the U shaped seat (111') in one piece.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A pivot hinge assembly for a glass structure, the hinge assembly comprising:

a central shaft adapted to be securely mounted on a doorframe;

a driving housing having:

an axial passage extending through the driving housing to receive therein the central shaft, and a radial passage defined to extend through the driving hosing and intercept the axial passage;

two pivoting devices respectively and oppositely received in the radial passage, each pivoting device being spaced away from one another by the central shaft;

a support having a U shaped seat formed to securely receive therein the driving housing and the two pivoting devices; and a front cover firmly engaging with the support to securely clamp a piece of glass of a pivot door on the U shape seat;

whereby when a user pushes the piece of glass of the pivot door, which is securely mounted on the U shaped seat, the glass drives the two pivoting devices to pivot relative to the central shaft which is adapted to be fixed to the doorframe via a base so as to facilitate the smoothness of pivotable movement of the pivot door, wherein the two pivoting devices comprises:

a pair of rollers, oppositely received in the driving housing from the radial passage and each roller being spaced apart from each other by the central shaft, a pair of sleeves, each received in the driving housing from the radial passage and having a channel defined through the sleeve to receive therein a spring, and a pair of plugs, each securely connected to a side of the driving housing to close an exit of the radial passage so as to retain the sleeve in the driving housing and allow the spring of the sleeve to abut the corresponding roller, wherein the central shaft has two oppositely defined grooves, each corresponding to one of the rollers so that when the pivot door is not pivoted, the rollers are received in the corresponding grooves of the central shaft.

2. The hinge assembly as claimed in claim 1, wherein cushion pads are provided between the front cover and the support so as to protect the piece of glass from damage.

3. The hinge assembly as claimed in claim 1, wherein each of the sleeves further comprises a second channel defined to receive therein a second spring.

4. The hinge assembly as claimed in claim 1, wherein the front cover has two screw holes defined to correspond to two holes in the support so that the front cover is able to engage with the support by two screws.

5. A pivot hinge assembly for a glass structure, the hinge assembly comprising:

a central shaft adapted to be securely mounted on a doorframe;

a driving housing having:

an axial passage extending through the driving housing to receive therein the central shaft, and a radial passage defined to extend through the driving hosing and intercept the axial passage;

two pivoting devices respectively and oppositely received in the radial passage, each pivoting device being spaced away from one another by the central shaft;

a support having a U shaped seat formed to securely receive therein the driving housing and the two pivoting devices; and a front cover firmly engaging with the support to securely clamp a piece of glass of a pivot door on the U shape seat;

whereby when a user pushes the piece of glass of the pivot door, which is securely mounted on the U shaped seat, the glass drives the two pivoting devices to pivot relative to the central shaft which is adapted to be fixed to the doorframe via a base so as to facilitate the smoothness of pivotable movement of the pivot door, wherein the two pivoting devices comprise:

a pair of rollers, oppositely received in the driving housing from the radial passage and each roller being spaced apart from each other by the central shaft, a pair of sleeves, each received in the driving housing from the radial passage and having a channel defined through the sleeve to receive therein a spring, and a pair of plugs, each securely and oppositely received in the driving housing to close an exit of the radial passage so as to retain the sleeve in the driving housing and allow the spring of the sleeve to abut the corresponding roller, wherein the central shaft has two oppositely defined grooves, each corresponding to one of the rollers so that when the pivot door is not pivoted, the rollers are received in the corresponding grooves of the central shaft.

6. The hinge assembly as claimed in claim 5, wherein cushion pads are provided between the front cover and the support so as to protect the piece of glass from damage.

7. The hinge assembly as claimed in claim 5, wherein each of the sleeves further comprises a second channel defined to receive therein a second spring.

8. The hinge assembly as claimed in claim 5, wherein the front cover has two screw holes defined to correspond to two holes in the support so that the front cover is able to engage with the support by two screws.

* * * * *